US006117298A

United States Patent [19]

Nakatsugawa

[11] Patent Number: 6,117,298

[45] Date of Patent: Sep. 12, 2000

[54] CATHODIC PROTECTIVE COATING ON MAGNESIUM OR ITS ALLOYS AND METHOD OF PRODUCING THE SAME

[75] Inventor: Isao Nakatsugawa, Hiroshima, Japan

[73] Assignee: Technologies Intermag Inc., Canada

[21] Appl. No.: 09/173,446

[22] Filed: Oct. 16, 1998

[30] Foreign Application Priority Data

Oct. 21, 1997 [CA] Canada ..... 2218983

[51] Int. Cl.[7] ..... C25D 11/00

[52] U.S. Cl. ..... 205/108; 205/321

[58] Field of Search ..... 205/108, 321, 205/704

[56] References Cited

U.S. PATENT DOCUMENTS

| | | | |
|---|---|---|---|
| 2,314,341 | 3/1943 | Buzzard | 204/56 |
| 2,426,254 | 8/1947 | Waterman | 204/56 |
| 4,094,750 | 6/1978 | Mackey | 204/56 R |
| 4,464,232 | 8/1984 | Wakano et al. | 204/28 |
| 4,515,671 | 5/1985 | Polan et al. | 204/228 |
| 5,240,589 | 8/1993 | Bartak et al. | 205/321 |
| 5,264,113 | 11/1993 | Bartak et al. | 205/321 |
| 5,380,374 | 1/1995 | Tomlinson | 148/247 |

*Primary Examiner*—Kathryn Gorgos
*Assistant Examiner*—Christopher M Keehan
*Attorney, Agent, or Firm*—George J. Primak

[57] ABSTRACT

A method is provided for treating a magnesium-containing article to form a cathodic protective coating on such article. This is done by electrochemically treating the article, acting as a cathode, in an alkaline solution, preferably at a temperature of between 40 and 80° C., with a cathodic current density of 5–200 mA/cm$^2$. The treatment produces a magnesium-containing article having a protective coating of magnesium hydride of predetermined thickness with a high count of hydrogen particles.

12 Claims, 1 Drawing Sheet

CATHODIC PROTECTIVE COATING ON MAGNESIUM OR ITS ALLOYS AND METHOD OF PRODUCING THE SAME

BACKGROUND OF THE INVENTION

1. Field of the Invention

This invention relates to the formation of a cathodic protective coating on magnesium or magnesium alloys and to the hydride or hydrogen-rich coating so formed. More specifically, such coating is produced by an electrochemical treatment in an alkaline bath containing hydroxide and supporting electrolytes with use of a source of cathodic current.

2. Brief Description of the Prior Art

Magnesium alloys have been increasingly utilized in structural applications. By minimizing metallic impurities and adding aluminum or rare-earth elements, the corrosion rates of magnesium alloys become comparable to those of carbon steels or A380 aluminum alloys in salt spray environment. Painting is a popular method to improve the corrosion resistance and to add decorative appearances. Chemical or electrochemical pretreatment is usually applied before painting to strengthen the adhesion between the paint film and Mg surface. These treatments also provide limited corrosion protection. Among them, chromium (VI) compound based chemical conversion coatings are known to offer a good paint base. However, because of its toxic nature, the handling of the solution and its disposal are of concern. As such, several non-chromium (VI) based coatings such as zirconium- or permanganate-based coatings have been developed (e.g. U.S. Pat. No. 5,380,374 of Jan. 10, 1995 entitled "CONVERSION COATINGS FOR METAL SURFACES"). These surface coatings, including chromium based coatings, usually require regular control of chemical composition, as chemicals are consumed during the operation.

Another electrochemical surface treatment of magnesium or its alloys is called "anodizing" or "anodization" and involves formation by anodic deposition of an oxide/hydroxide or similar protective film or coating on the magnesium article. Examples of such treatments are disclosed, for example, in U.S. Pat. Nos. 2,314,341 and 2,426,254. There are also two-step processes where the magnesium article is first pre-treated in a chemical or electrochemical solution, before being subjected to the anodic deposition of the protective coating. Examples of such two-step processes may be found in U.S. Pat. Nos. 5,240,589 and 5,264,113. These processes employ an anodic technique, i.e. the Mg substrate is polarized to a more positive voltage.

OBJECT AND SUMMARY OF THE INVENTION

It is an object of the present invention to provide a cathodic protective coating on magnesium or its alloys which has a number of significant advantages over the anodic coating and conversion coatings.

Another object is to provide a simple and efficient method for effecting such cathodic coating.

Other objects and advantages of the invention will be apparent from the following description thereof.

In essence, the Mg substrate is polarized according to the present invention to a more negative voltage so that the current direction and the nature of the formed film are completely different from the prior art.

The method of the present invention, therefore, comprises electrolytically forming a protective coating on a magnesium containing article by electrochemically treating the article, acting as a cathode, in an alkaline solution, preferably having a pH of between about 10 and 14, at a temperature of between 20 and 90° C., preferably between 40 and 80° C., using a cathodic current density of 5–200 mA/cm$^2$, preferably 20–100 mA/cm$^2$. A hydrogen rich protective layer of magnesium hydride is thereby formed on the magnesium article essentially without corroding the surface of the article. This can be done by imposing a cathodic DC current, but it is preferable to use a cathodically biased AC current to shorten the process time of hydride formation. In particular, the use of biased square wave current, or intermittent current with a frequency of up to 5 Hz, preferably 0.1–3 Hz is recommended for the ease of instrumentation. During the treatment, hydrogen gas evolution is observed on the Mg article and it is, therefore, advisable to operate under a good ventilation.

The alkaline solution in which the magnesium article is treated may be prepared by adding alkali metal hydroxide, ammonium salts or similar alkaline materials. The addition of NaOH or KOH to water provides the most convenient and economical solution. Some supporting electrolyte, such as $KNO_3$ or $Na_2SO_4$, may also be added to minimise the solution resistance and to assure uniform current distribution. There is no particular limitation for the choice of the supporting electrolyte, however the use of chlorides is not desirable as it would damage the anode materials during the operation. Also, although operating temperatures may range from room temperature (20° C.) up to close to the boiling temperature (90° C.), temperatures below 40° C. and above 80° C. would retard the reaction and lengthen the time of deposition of the protective coating. There is no particular limitation of the process time which can be as short as 5 or 10 minutes, although preferably it will be 20 minutes or longer. The treatment with longer periods, for example 2 hours, or even 8 to 16 hours, will be useful to obtain a stand-alone protective coating. However, if the coating is used as a paint base, a treatment for 20–40 minutes is usually sufficient. The time of treatment depends on the current density employed: the smaller the current density, the longer the treatment time. After the treatment, the colour of the Mg surface will change to light gray.

Since only water is consumed during the treatment, no complicated analytical procedure is required to maintain the concentration of the chemical compounds. However, it may be useful to control the conductivity and the pH within the desired ranges to ensure the quality of the coating and to avoid unnecessary anodic dissolution of anode materials during the process.

The obtained magnesium-containing article has a protective coating of magnesium hydride of predetermined thickness and a high count of hydrogen particles. The novel magnesium-containing article of the present invention shows a passivation phenomenon at anodic potentiodynamic curve in 5% NaCl solution saturated with $Mg(OH)_2$, which has a passivation current in the range of 0.1–100 $\mu$A/cm$^2$.

BRIEF DESCRIPTION OF THE DRAWINGS

The invention will further be described with reference to the accompanying drawing in which.

DETAILED DESCRIPTION OF THE INVENTION

Figure 1:
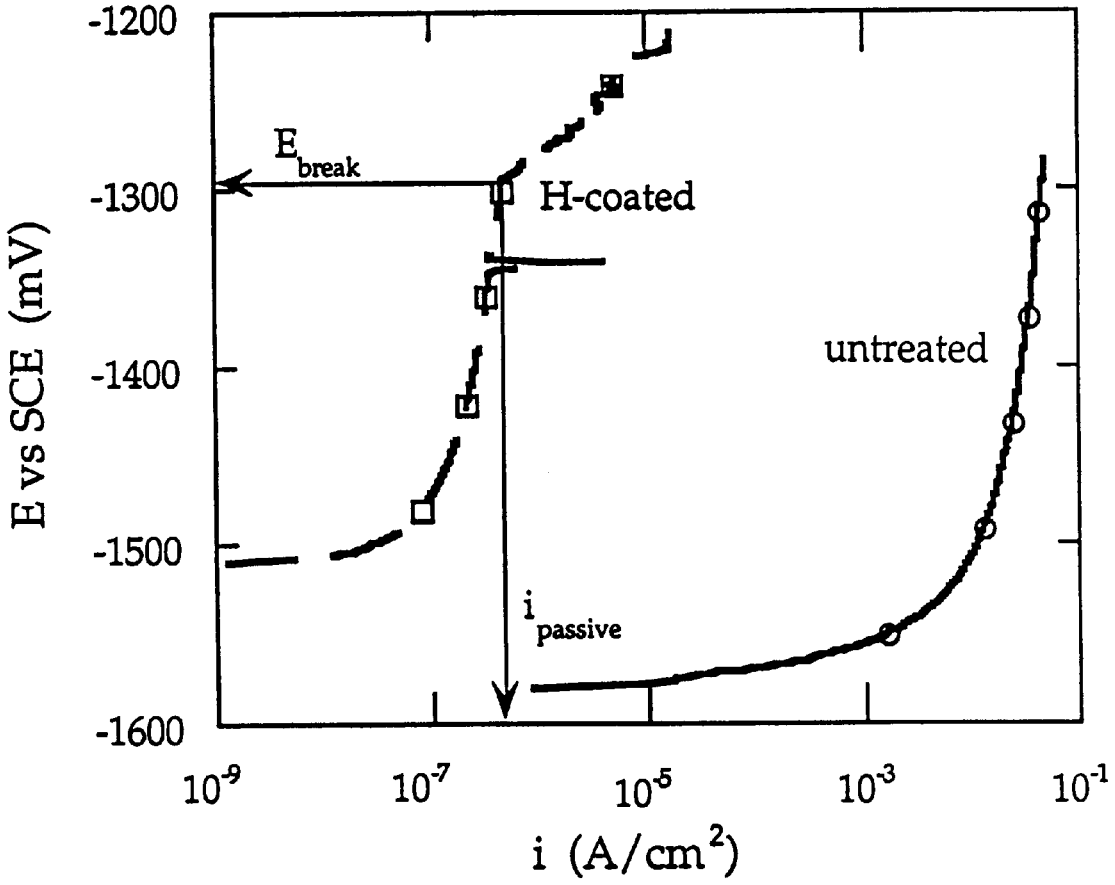
FIG. 1 shows the potentiodynamic anodic polarization curves of untreated and of hydride coated test specimen pursuant to the present invention.

The presence of hydride layer and its effect on the corrosion resistance can be readily checked by electrochemical techniques. FIG. 1 shows the potentiodynamic anodic polarization curves of untreated and of hydride coated (H-coated) AZ91D test specimen in 5 wt % NaCl solution saturated with $Mg(OH)_2$. The process conditions are the same as in EXAMPLE 1 given below in the EXAMPLES. $Mg(OH)_2$ is added to have a stable pH around 10.5. For the untreated specimen, the current increases at higher anodic potential, which means the specimen is corroding actively. In case of the treated specimen, the current shows an almost constant value (named $i_{passive}$) of less than 1 $\mu A/cm^2$ up to −1300 mV (this potential is named $E_{break}$). After $E_{break}$, the current is rapidly increased. Such behaviour indicates that the surface is in a passive state with negligible corrosion rate, and is explained by the formation of a protective hydride layer.

The value of $i_{passive}$ and $E_{break}$ are useful indicators of the degree of passivation. Smaller $i_{passive}$ and more noble $E_{break}$ mean the presence of a stable film and the corrosion rate is small. With this analysis, the effect of operating conditions was evaluated.

Table 1 below shows the values of $i_{passive}$ and $E_{break}$ at different operating conditions where 0.2 M $Na_2SO_4$ was added to the bath solution as supporting electrolyte. In some cases, the measurement was terminated before $E_{break}$ appeared; in such cases, the current values at the termination were recorded.

TABLE 1

| sample No. | Frequency (Hz) | Current (−mA/cm²) | Temp. (° C.) | pH | Time (hour) | Passi-vation | $i_{passive}$ ($\mu A/cm^2$) | $E_{break}$ (mV vs. SCE) |
|---|---|---|---|---|---|---|---|---|
| 1 | 0 | 50 | 60 | 12 | 2 | No | — | — |
| 2 | 0.1 | 50 | 60 | 12 | 2 | No | — | — |
| 3 | 0.5 | 50 | 60 | 12 | 2 | Yes | 0.46 | −1295 |
| 4 | 1.0 | 50 | 60 | 12 | 2 | Yes | 0.79 | −1381 |
| 5 | 5.0 | 50 | 60 | 12 | 2 | No | — | — |
| 6 | 0.5 | 5 | 60 | 12 | 2 | Yes | 13.2 | −1500 |
| 7 | 0.1 | 100 | 60 | 12 | 3 | Yes | 2.90 | −1400 |
| 8 | 0.1 | 200 | 60 | 12 | 3 | No | — | — |
| 9 | 0.5 | 200 | 60 | 12 | 2 | No | — | — |
| 10 | 0.1 | 50 | 22 | 12 | 3 | No | — | — |
| 11 | 0.1 | 50 | 22 | 12 | 7 | Yes | 8.44 | −1514 |
| 12 | 0.1 | 50 | 22 | 12 | 16 | Yes | 6.38 | −1418 |
| 13 | 0.1 | 50 | 40 | 12 | 6 | Yes | 0.71 | −1330 |
| 14 | 0.1 | 100 | 80 | 12 | 3 | Yes | 1.65 | −1472 |
| 15 | 0.5 | 50 | 90 | 12 | 3 | No | — | — |
| 16 | 0.5 | 50 | 60 | 5.7 | 2 | No | — | — |
| 17 | 0.5 | 50 | 60 | 10.5 | 2 | Yes | 6.15 | >−1350 |
| 18 | 0.5 | 50 | 60 | 13.3 | 2 | Yes | 2.33 | >−1310 |
| 19 | 0.5 | 50 | 60 | 12 | 0.1 | Yes | 31.6 | −1544 |
| 20 | 0.5 | 50 | 60 | 12 | 0.2 | Yes | 23.1 | −1539 |
| 21 | 0.5 | 50 | 60 | 12 | 0.5 | Yes | 21.5 | >−1460 |
| 22 | 0.5 | 50 | 60 | 14 | 0.5 | Yes | 49.7 | >−1460 |
| 23 | 0.5 | 50 | 60 | 12 | 5 | Yes | 0.60 | −1235 |

From the above results we can determine the most appropriate conditions to achieve the coating according to the present invention, namely:

1. Frequency: The passivation is not observed at DC current or intermittent current input higher than 5 Hz (c.f. samples Nos. 1 and 5 above). Thus:

the broadest suitable frequency range is from 0 to 5 Hz a preferable frequency is from 0.1 to 3 Hz the most preferable frequency range is from 0.5 to 1 Hz.

2. Current: The passivation is observed even at −5 $mA/cm^2$ (c.f. sample No.6) The passivation is not observed at the current higher than −200 $mA/cm^2$ (c.f. samples Nos. 8 and 9). Thus:

the broadest suitable current density range is −5 to −200 $mA/cm^2$ a preferable current density range is −20 to −100 $mA/cm^2$ the most preferable current density range is −30 to −80 $mA/cm^2$.

3. Bath temperature: The passivation is observed even at room temperature after 7 hours of treatment (c.f. samples Nos. 10–12). The passivation is not observed at the temperature of 90° C. (c.f. sample No. 15). Thus:

the broadest temperature range is from 20 to 90° C.

a preferable temperature range is from 40 to 80° C.

the most preferable temperature range is from 50 to 70° C.

4. pH: The passivation appears when the pH is higher than 10.5 (c.f. samples Nos. 16 and 17). Thus:

the broadest pH range is from 7 to 15 a preferable pH range is from 10 to 14 the most preferable pH range is from 11 to 13.

5. Operation time: The passivation is observed even after 10 minutes of treatment (c.f. sample No. 19). Thus:

the broadest time range is 5 minutes or longer a preferable time range is 10 minutes or longer the most preferable time range is 20 minutes or longer.

From the above experiment, the most preferable condition is found in samples Nos. 3 and 21, in which:

| | |
|---|---|
| Frequency: | 0.5 Hz |
| Current density: | −50 $mA/cm^2$ |
| Bath temperature: | 60° C. |
| pH: | 12 (containing 0.2 M $Na_2SO_4$) |
| Operation time: | 0.5 to 2 hours. The treatment of 0.5 hour is preferable for paint base. The treatment of 2 hours is useful as a stand alone protective coating. |

The above features relate, however, to specific testing conditions and are not to be considered as limitative for all situations. Thus, any magnesium-containing article with the anodic coating, having a passivation current in the range of 0.1–100 $\mu A/cm^2$ falls within the scope of the present invention.

EXAMPLES

The invention will now further be described by means of the following non-limitative examples:

EXAMPLE 1

For this example, two diecast test specimens of magnesium alloy AZ91D were used. After mechanical polishing and degreasing with acetone, specimens were immersed in 10 wt % HF solution for 30 seconds. Thereafter, one of the specimens was treated by the method of the present invention using the following operating conditions:

Bath solution composition: 0.01 M NaOH+0.2 M $Na_2SO_4$ pH≈12

Bath solution temperature: 60° C.

Current input: intermittent cathodic current

Amplitude: −50 $mA/cm^2$

Frequency: 0.5 Hz

Duration: 2 hours

The two specimens, one treated as indicated above, and the other untreated were immersed in 5 wt % NaCl solution saturated with $Mg(OH)_2$ for 21 days. The weight loss corrosion rate of the specimens was evaluated after removing the corrosion products by $CrO_3$ solution. The result of the immersion test is shown in the following Table 2.

TABLE 2

| | Corrosion rate ($mg/cm^2/day$) |
|---|---|
| untreated specimen | 0.15 |
| treated specimen | 0.05 |

It is seen from the above results that the corrosion rate of the specimen treated in accordance with this invention decreased to ⅓ of the untreated specimen.

EXAMPLE 2

The paintability of the novel treatment compared to other surface finishing methods was evaluated using AZ91D diecast test plates. Prior to the treatment, the surface was polished with #600 emery paper and degreased with acetone. Acid etching with 10 wt % HF solution was conducted for 30 seconds. Some test plates were left untreated while others were treated pursuant to the present invention using the following operating conditions:

Bath solution composition: 0.01M NaOH+0.2 M $Na_2SO_4$ pH≈12

Bath solution temperature: 60° C.

Current input: intermittent cathodic current

Amplitude: −50 $mA/cm^2$

Frequency: 0.5 Hz

Duration: 30 minutes

For comparison, dichromate treatment (chemical treatment No. 7; MIL-M-3171, Type III) and modified chrome pickle treatment (chemical treatment No. 20) were applied according to the standard procedure (ASM Metal Handbook vol. 5, p. 824 (1994)). An acrylic based powder coating was applied to treated specimens, following the baking at 204° C. for 7 minutes. After the coating, each surface was scribed by a sharp knife according to ASTM D1654. Specimens were then exposed to salt spray environment (ASTM B117) for 312 hours.

Table 3 below shows the rating of surface finishing employed in this study. The novel treatment is ranked as A, comparable to chemical treatments Nos. 7 and 20.

TABLE 3

| | Blister | Adhesion | Corroded area | Total | Rank |
|---|---|---|---|---|---|
| untreated | 4 | 4 | 4 | 12 | C |
| invented treatment | 9 | 10 | 10 | 29 | A |
| treatment No. 7 | 9 | 10 | 9 | 28 | A |
| treatment No. 20 | 10 | 10 | 8 | 28 | A |

EXAMPLE 3

For this example, AZ91D diecast test specimens were used. After mechanical polishing and degreasing with acetone, specimens were immersed in 10 wt % $HNO_3$ solution for 10 seconds. The specimens were then treated by the method of the present invention under the following operating conditions:

Bath solution composition: 0.01 M NaOH+0.1 M $Na_2SO_4$ pH=12

Bath solution temperature: 20° C.

Current input: intermittent cathodic current

Amplitude: −50 $mA/cm^2$

Frequency: 0.1 Hz

Duration: 8 and 16 hours respectively

The hydrogen content of the so treated specimens was measured by Elastic Recoil Detection Analysis. Existence of accumulated hydrogen particles of treated specimens was clearly seen. The treated specimens had a protective coating of magnesium hydride of a thickness of up to about 1 $\mu m$ where the hydrogen particle count was at least 200. At a depth of 0.5 $\mu m$ from surface, the hydrogen particle count of the treated specimens was above 500. At certain lesser depths from the surface the hydrogen count was close to 1000 or even 1500 or higher depending on the time of treatment and other operating conditions.

Although this invention has been described with reference to its preferred embodiments and examples, it should be understood that many modifications can be made by those skilled in the art without departing from the spirit of the present invention and the scope of the following claims.

What is claimed is:

1. A method of forming a protective coating of magnesium hydride on a magnesium-containing article which comprises electrochemically treating said article, acting as a cathode, in an alkaline solution with a cathodic current density of 5–200 $mA/cm^2$ until a hydrogen rich protective layer of magnesium hydride is formed on said article.

2. A method according to claim 1, wherein the treatment is effected at a temperature of between 20 to 90° C.

3. A method according to claim 1, wherein the cathodic current is a biased square wave current or intermittent current with a frequency of up to 5 Hz.

4. A method according to claim 1, wherein the pH is between about 10 and 14.

5. A method according to claim 1, wherein the cathodic current density is between 20 and 100 $mA/cm^2$.

6. A method according to claim 3, wherein the frequency is between 0.1 and 3 Hz.

7. A method according to claim 1, wherein the alkaline solution is prepared by adding NaOH or KOH to water.

8. A method according to claim 1, which comprises further adding a supporting electrolyte to the solution to minimize the solution resistance and to assure uniform current distribution.

9. A method according to claim 8, wherein the supporting electrolyte is $KNO_3$ or $Na_2SO_4$.

10. A method according to claim 1, which is carried out in the absence of chlorides.

11. A method according to claim 1, where a treatment of 20 to 40 minutes is used to obtain a coating suitable as a paint base.

12. A method according to claim 1, where a treatment of at least 2 hours is used to obtain a stand alone protective coating.

* * * * *